US009604087B2

(12) United States Patent
Brown et al.

(10) Patent No.: US 9,604,087 B2
(45) Date of Patent: Mar. 28, 2017

(54) ROPE CLIMBING SYSTEMS AND METHODS OF USE

(71) Applicant: The United States of America as represented by the Secretary of the Navy, Washington, DC (US)

(72) Inventors: Christopher Brown, Bloomington, IN (US); Lawrence Shirley, II, Bloomfield, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 4 days.

(21) Appl. No.: 14/849,788

(22) Filed: Sep. 10, 2015

(65) Prior Publication Data

US 2017/0001055 A1 Jan. 5, 2017

Related U.S. Application Data

(60) Provisional application No. 62/186,849, filed on Jun. 30, 2015.

(51) Int. Cl.

| | |
|---|---|
| ***A62B 1/14*** | (2006.01) |
| ***A63B 7/04*** | (2006.01) |
| ***A63B 29/02*** | (2006.01) |
| *A62B 35/00* | (2006.01) |

(52) U.S. Cl.

CPC ..... *A63B 7/04* (2013.01); *A62B 1/14* (2013.01); *A63B 29/02* (2013.01); *A62B 35/00* (2013.01)

(58) Field of Classification Search

CPC .... A62B 1/00; A62B 1/02; A62B 1/06; A62B 1/08; A62B 1/10; A62B 1/12; A62B 1/14; A62B 1/16; A62B 1/18; A62B 1/20; A62B 1/22; A63B 29/00; A63B 29/02; A63B 29/024; A63B 29/028; A63B 69/0064; E04G 21/32; E04G 21/3204; E04G 21/3261; B64D 23/00; B66D 1/7489; B63H 9/10

See application file for complete search history.

(56) References Cited

U.S. PATENT DOCUMENTS

| | | | | |
|---|---|---|---|---|
| 3,782,718 A * | 1/1974 | Saylor | A63B 7/04 482/37 |
| 5,146,655 A * | 9/1992 | Gibbs | A44B 99/00 188/65.2 |
| 7,513,334 B2 * | 4/2009 | Calver | B66D 1/7415 182/133 |
| 9,211,426 B2 * | 12/2015 | Baum | A62B 35/00 |
| 2016/0297651 A1 * | 10/2016 | Timmermans | B66D 1/7415 |

* cited by examiner

*Primary Examiner* — Sundhara Ganesan
*Assistant Examiner* — Rae Fischer
(74) *Attorney, Agent, or Firm* — Christopher A. Monsey

(57) ABSTRACT

Various apparatuses for rope-climbing and associated methods are provided. Embodiments include a circular loop of rope and a variable braking system allowing for a freely suspended rope-climbing experience a safe distance from the ground and at a speed variable to individual users.

13 Claims, 14 Drawing Sheets

Fig. 3
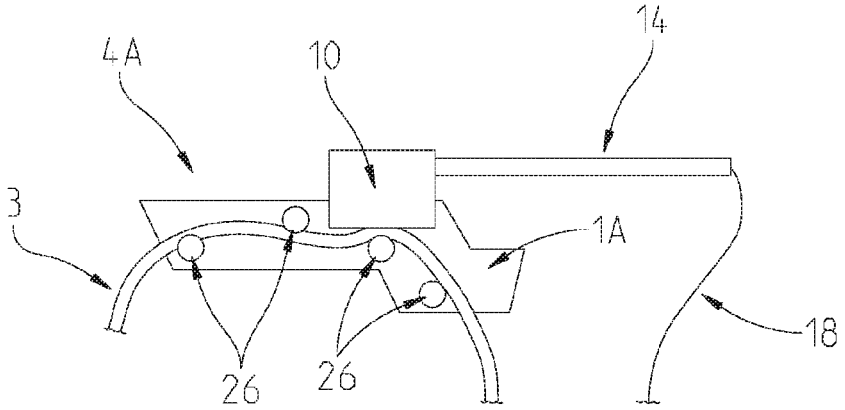
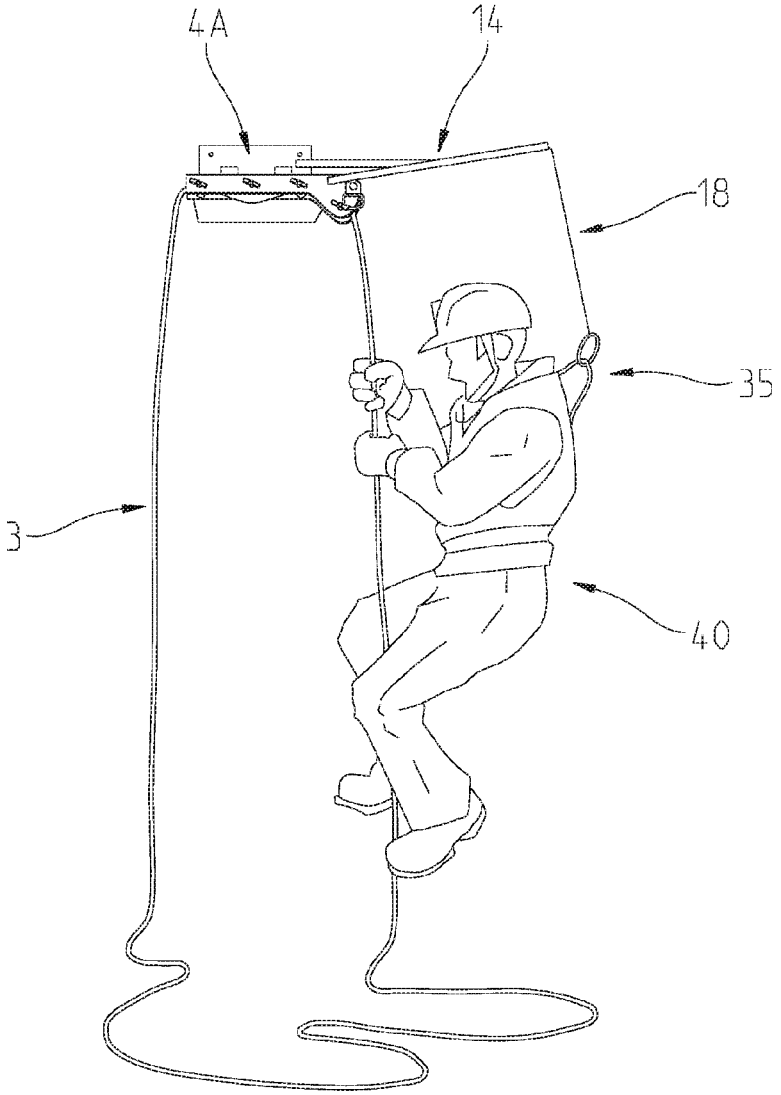
Fig. 4

Fig. 5
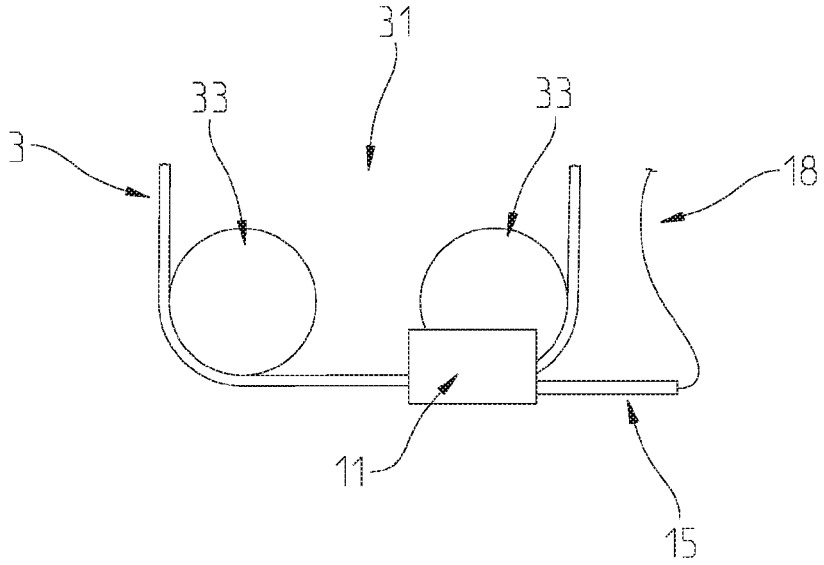
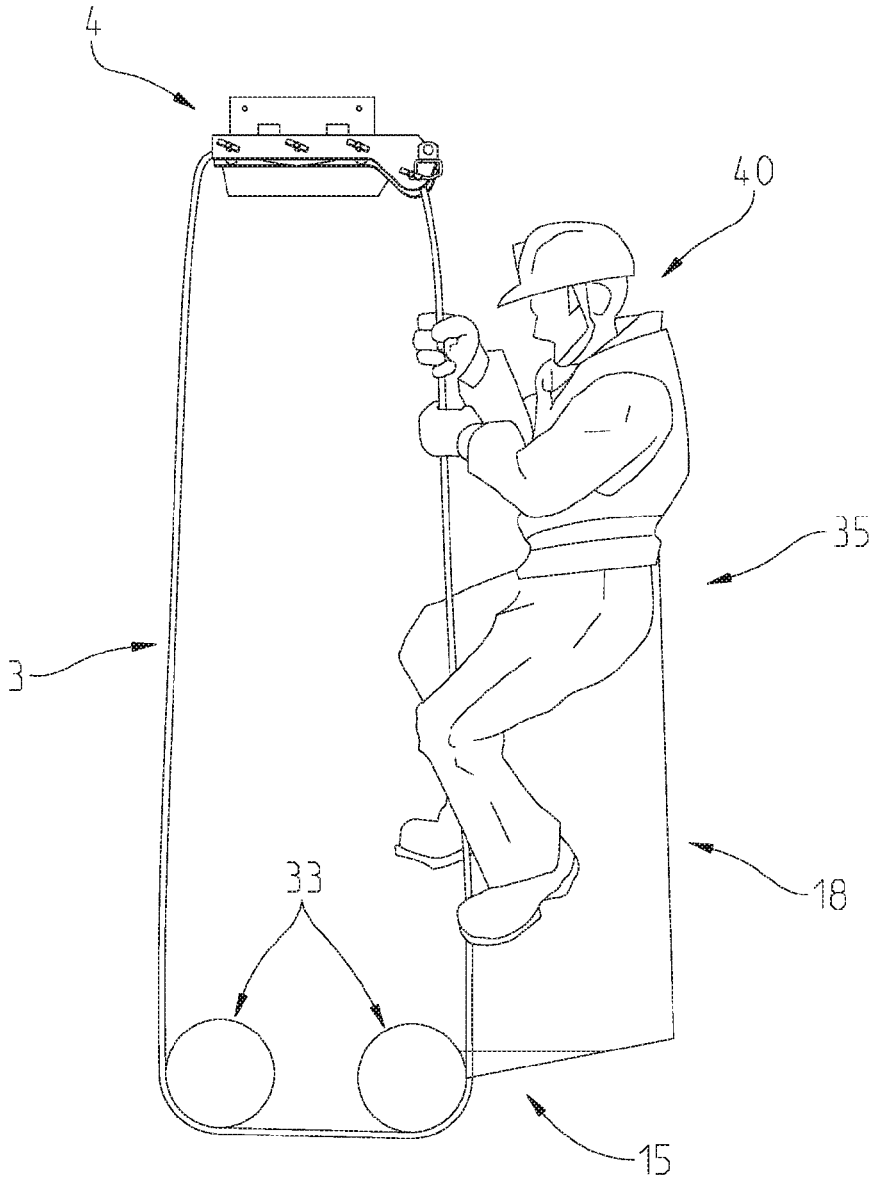
Fig. 6

Provide, access, or initiate use or operation of a rope climbing system (e.g., see Fig. 17, ) that includes a first apparatus comprising a housing having a first and second axis where said first axis is perpendicular to said second axis, an adjustable threaded structure coupled to said housing, a set of pulleys including an adjustable rope tension pulley assembly disposed in said housing, a loop of textured rope disposed through and on the set of pulleys, a brake disposed in said housing attached to a brake boom that extends away from the brake and said housing within an arc defined by an angle of up to thirty degrees above and below said first axis, a spring connected to both the brake boom and said adjustable threaded structure, and an elastic cable connected to a first end of the brake boom on an opposing end of a second end of the brake boom coupled to the brake, wherein the elastic cable further comprises an attaching mechanism adapted to attach to a rope climber who ascends a portion of the rope, wherein said rope extends away from said housing at rest along said first axis and from a first and second location of said housing, wherein said elastic cable has a first length configured to enable said elastic cable to stretch between ten and thirty percent of its length from a fully down deflected position of said brake boom down to a point above a support surface underneath said rope climbing system that said rope climber will assume as an initial climbing position at which the elastic rope is coupled to said rope climber's body, wherein said elastic rope is configured or formed to decrease an elastic force on said brake boom until said rope climber ascends to a point on said loop that all said elastic force is relaxed on said brake boom, wherein said elastic force is proportional to an amount of torque the brake boom applies to said brake, wherein said a friction force is applied by said brake is altered or adjusted by altering position of at least one said adjustable rope tension pulley assembly or the adjustable threaded structure that adjusts position of said spring, wherein said adjustable threaded structure is adapted to selectively move said brake towards or away from a section of said rope between one of said pulleys and said brake to apply or release said friction force against said section of said rope, wherein said housing is further formed with first and second elongated apertures which is parallel to said axis and is formed on opposing sides of said adjustable rope tension pulley assembly and is configured to enable said adjustable rope tension pulley assembly to move within said aperture to alter said friction forces on said section of said rope, said adjustable rope tension pulley assembly is further formed with a threaded knob that threadedly engages with said adjustable rope tension pulley assembly to apply a movement restriction force to said adjustable rope tension pulley assembly to fix said adjustable rope tension pulley assembly relative to said housing.

401

To Fig. 21B

Fig. 21A

Initiate operation of a rope climber system, e.g., such as that which is described in Fig 20, that includes a first apparatus comprising a first controller, a first user interface in wired communication with the first controller, a rope braking system and a brake actuator, a primary wireless unit positioned in proximity with the controller, an endless loop of rope, and a plurality of contact surfaces to direct the rope including a final surface that is the last directive surface that a portion of the endless loop of rope interacts with before that portion of the endless loop of rope exits the first apparatus; the system further including a second apparatus comprising a secondary wireless unit, a second user interface, and a second controller in a user case configured to attach to the user, wherein the primary wireless unit is configured to communicate with the secondary wireless unit positioned on a user, wherein the first apparatus is further configured to determine an actual distance between the primary and secondary wireless units based on wireless transmission distance measurements, the controller further includes a section configured to receive a brake release distance setting, and a re-engagement distance via the user interface, wherein the brake release distance setting defines a rope release distance between the primary and secondary units when the controller operates the braking actuator to release the rope controlled by the apparatus to permit the rope to circulate until the re-engagment distance is measured between the primary and secondary wireless units, wherein the contricller is further configured to apply a variable friction to the rope based on distance between the primary wireless unit and the secondary wireless unit having a pre-determined and user-defined maximum and minimum rope release rate points at set but varialble distances that can be established via the first or second user interface, wherein the controller is further configured to determine a distance between the secondary wireless unit and the final directive surface via a computation performed by the first controller, the computation being, e.g., the Pythagorean theorem using the measured distance as the hypotenuse and a predetermined distance between the first wireless unit and the final directive surface as a leg of a right triangle, and wherein the first apparatus further comprises a rope speed sensor comprising an motor-generator including an electronic database of a table of voltage to rope speed ratios, a processor, and a pulley about which runs the rope, wherein the circulation of the rope spins the pulley of the motor-generator to produce a voltage, the processor then references the induced voltage to the database to determine the speed of rope, and wherein the first apparatus is secured to a wall, ceiling, or other support surface.

501

To Fig. 22B

Fig. 22A

ROPE CLIMBING SYSTEMS AND METHODS OF USE

CROSS-REFERENCE TO RELATED APPLICATIONS

The present application claims priority to U.S. Provisional Patent Application Ser. No. 62/186,849, filed Jun. 30, 2015, entitled "ROPE CLIMBING SYSTEM AND METHODS OF USE," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,254) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to a rope climbing training and/or exercise devices and methods designed to accurately simulate experiences of ascending a freely suspended rope while eliminating or minimizing various risks associated with such ascents. In particular, various embodiments of the invention are configured for maintaining a climber at a safe distance from a surface the rope is suspended above while enabling the climber to ascend or climb at their chosen or personalized rate of ascent which can be controlled based on their ascent position as well as speed of ascent.

Rope climbing presents certain physical risks. Often, climbing requires climbers to ascend to tall heights, which not only inconveniently requires a substantial vertical space for implementation but also presents a serious hazard for personal injury through falling, especially for untrained or inexperienced users. Use of a continuous loop as opposed to a single terminal length of rope removes the necessity for such heights, but this, too, presents challenges such as how to address designs and rates by which to feed more rope to the user by circulating the rope towards the climber. Attempts to design safer alternatives are complicated by a need for a user to be freely suspended desired or needed climbing position as opposed to supporting a participant in some form, including seated or kneeling positions.

In general, embodiments of the apparatus address design difficulties of creating new types of rope climbing exercise devices. For example, an apparatus can be provided that can be mounted at a height on a vertical surface or ceiling and through which runs a continuous loop of rope that freely suspends a climber at a safe distance from the ground or supporting surface. Such an apparatus enables movement of the climber's rope at some points and restricts, slows, or halts movement of the rope at other stages of climbing based on position or movement of a climber relative to the rope, support surface, and/or apparatus. An exemplary rope braking mechanism can be provided with various embodiments that locks or slows a loop of rope until the climber ascends to a predetermined distance up on the rope. When the apparatus, e.g., a sensor or tether coupled with the climber, responds to or detects that the climber has reached this predetermined point or points, including adjustable or programmable points, the brake responds and is released automatically. A motor or effects of weight of the climber on the rope circulates the loop towards the climber upon brake release thereby lowering the rope towards the climber and providing more rope length to ascend. Examples of the invention respond to climber's movements thus allowing the climber to climb at his or her own pace while providing a freely suspended rope-climbing exercise a safe distance from the ground without an unwieldy vertical length of rope.

According to an illustrative embodiment of the present disclosure, an endless loop of rope can be fed through an apparatus that contains a series of pulleys and a braking system, a housing for the exemplary apparatus that is mounted on a vertical surface or ceiling, a boom attached to the braking system extending out from the housing, a tether or connecting structure connecting an outer section of the boom with a climber, and a connecting structure such as a harness which couples the climber with the tether or connecting structure. This exemplary braking system reduces or removes tension or friction on the rope when the climber is within a portion of an area of the rope which can be defined as above a fixed or adjustable distance from a support surface up the rope. The braking system can be engaged to fix the rope in a specific position with respect to the housing until the climber ascends to a first climbing distance then the brake system can start removing friction or braking effect to start permitting the rope to move downwards while the climber is ascending. The speed of rope movement downwards can increase or decrease based on how far up the rope the climber ascends with speed increasing and friction from the brake decreasing as the climber attempts to move closer to the housing. This exemplary braking system exemplary embodiment can be coupled to a boom that extends outwards from the housing. An elastic cable that couples the boom to the climber. When this exemplary cable is secured to the climber via a tether or other structure, his or her weight puts tension on the cable that then displaces or tugs down on the boom. This boom displacement due to cable tension actuates the exemplary braking system that thus holds the rope in place, allowing the climber to ascend. The exemplary cable can be made from elastic material that stretches and thus creates boom tension until the climber ascends to some point on the rope. The exemplary boom can also be designed to flex downward to apply force to the braking system until the climber ascends to some point on the rope. As the climber ascends, tension is reduced from the cable and, therefore, from the boom as well. This lifting of the boom begins to release tension on the brake, allowing the rope to circulate towards the climber due to gravity and climber's climbing motion. Circulation of the rope occurs as braking force is released thus lowers the climber, providing more space to climb. As the climber climbs faster than the rope circulates in the apparatus, the climber will ascend; as the climber moves higher along the rope or closer to the apparatus's housing the brake increasingly allows the rope to circulate faster. In this manner, this embodiment of the invention allows a freely suspended rope-climber to ascend at a unique, variable, and personal rate.

According to a further illustrative embodiment of the present disclosure, an endless loop of rope is again fed through an apparatus containing a series of pulleys that is mounted on a vertical surface or ceiling. In this embodiment, another set of pulleys, including a braking system, is incorporated into the system at the bottom end of the endless loop of rope in a separate mechanical unit secured on a ground or supporting surface or mounted onto a vertical surface. A boom extends outwards from the braking system and connects to both the climber via an elastic cable. In an initial configuration position, the brake exerts sufficient tension on the loop of rope to hold it in place. As the climber ascends, tension is put on the cable, lifting the boom and releasing tension on the brake, allowing the rope to circulate towards the climber through gravity and climber's climbing motion. Circulation of the rope thus lowers the climber, providing more length to climb. If the climber climbs faster than the circulation of the rope, the climber will further ascend resulting in further releases of the brake, circulating the rope faster. In this manner, the rope circulation is able to match the variable and unique rate of an individual climber.

Another embodiment can include use of a flexible boom which displaces based on weight of the climber that permits the climber to attach the boom tether or coupling structure to the climber in preparation for climbing up the apparatus' rope. Another embodiment can include an adjustable tether or coupling structure which permits adjustment of the tether or coupling structure based on, e.g. height of a climber, so as to adjust operation of the braking system.

Another embodiment of the present disclosure can entail use of a mechanical brake release can be replaced by an electronic wireless system. Again an endless loop of rope is passed through an apparatus containing a series of pulleys and a braking system. The braking system may be located in an additional set of pulleys at the lower end of the loop. Instead of a mechanical boom that releases tension on the brake, a primary wireless device is mounted on the apparatus and connected to the brake system. The climber also wears a secondary wireless device, possibly around the arm on a strap. When activated, the two devices constantly measure their proximity to each other, and this distance between the two units determines the amount to release or tighten the brake according to a predetermined, programmable ratio. For example, if the primary wireless unit is located in the main, overhead pulley apparatus, it is programmed to slowly release the brake as the worn secondary wireless unit draws nearer. With this arrangement, as the climber ascends, drawing the worn secondary wireless unit nearer to the primary one, the brake will be released proportionally, circulating the rope towards the climber. Similarly, if the primary wireless device is located in the supplemental, lower pulley system, the exemplary system is designed to release the brake proportionally to an increasing distance between the two units, according to a predetermined and programmable ratio of distance to magnitude of brake release. In this arrangement, as the climber ascends, the distance between the climber and primary wireless unit will increase, releasing the brake and circulating the rope towards the climber. This embodiment also allows for a freely suspended rope climbing experience to take place a safe distance from the floor at a personalized and variable rate for the user.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIG. 3 shows a side view with a partial cross section of another embodiment of the disclosure;

FIG. 4 shows a side view of a climber using one embodiment utilizing an upper boom release system;

FIG. 5 shows a side view of another embodiment that includes a supplemental, separate pulley system;

FIG. 6 shows a side view of a climber using one embodiment utilizing a lower boom release system;

FIGS. 21A and 21B show a method of operation related to an exemplary embodiment of the invention;

FIG. 22A shows another method of operation related to an exemplary embodiment of the invention.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
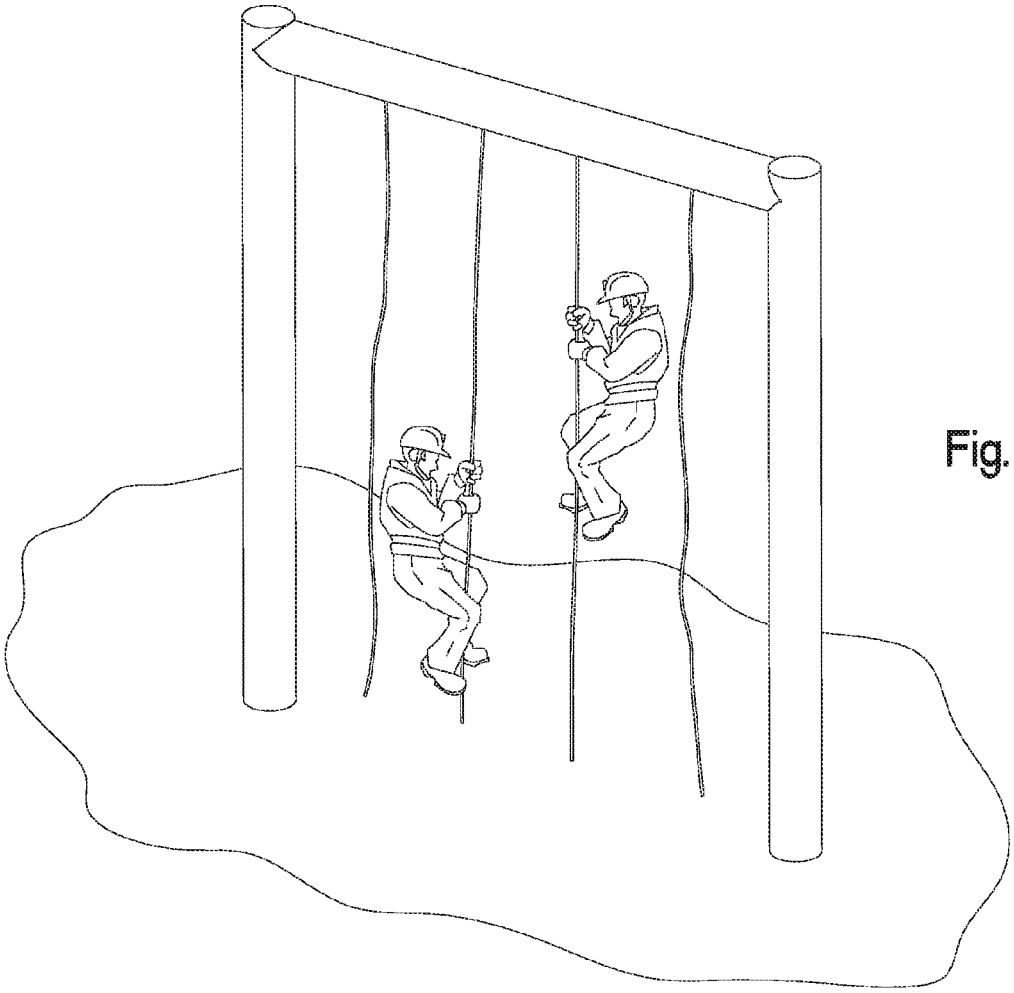
FIG. 1 depicts existing rope climbing equipment during a rope climbing exercise.

FIG. 1 shows existing equipment required to execute a rope-climbing exercise. Performing such an action requires large vertical spaces that may be an inefficient or an impractical use of facilities at a given location. Moreover, heights pose a serious risk of personal injury to climbers due to falling, which is particularly a risk to those who may be untrained or inexperienced. Embodiments of the invention address various risks of existing climbing approaches while preserving a freely suspended rope-climbing exercise.

Figure 2:
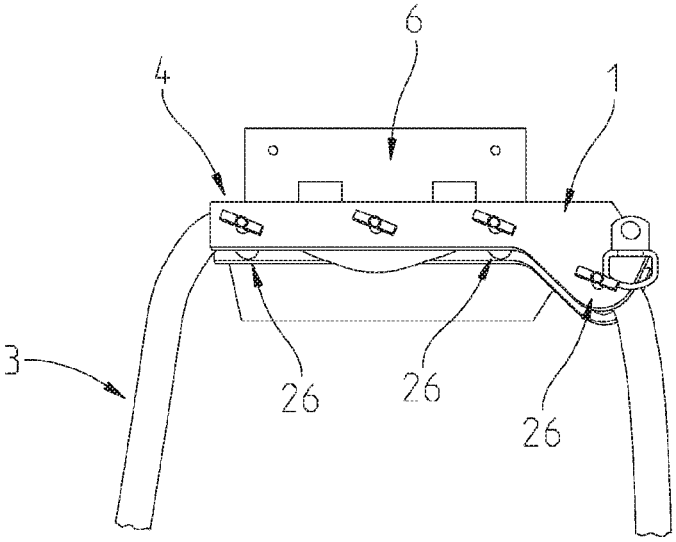
FIG. 2 shows a simplified external side view of an embodiment of the disclosure mounted on a structural frame.

Referring to FIG. 2, an illustrative example is shown in an external perspective side view. A rope climbing apparatus 4 is generally comprised of a structural framework 1, with a set of pulleys 26 through which an endless loop of rope 3 is fed. Finally, the FIG. 2 apparatus 4 can be secured to a mounting surface by a mount 6. Mounting surfaces can include ceilings and walls as well as free standing structures such as tripod or other mounting structures.

FIG. 3 shows a side view in partial cross section of another embodiment of the disclosed invention. Exemplary apparatus 4A generally includes a structural framework 1A and a set of pulleys 26 through which an endless loop of rope 3 is fed. In this embodiment, an upper braking system 10 that is able to secure and lock the endless loop of rope 3 can be incorporated into exemplary apparatus 4A. An upper brake boom 14 can be connected to the upper braking mechanism 10. A brake cable 18 can be connected to and extends downward from the upper brake boom 14. In some embodiments, brake cable 18 can be formed from an elastic material that stretches down to permit a climber (not shown) to attach the brake cable 18 at an initial starting or climbing position relative to the rope 3. Tension on this exemplary upper braking system 10 is not relieved until the climber ascends to a predetermined distance that the elastic brake cable 18 is no longer stretched or under tension then the upper braking system 10 moves upward. When the upper braking system 10 moves upward a loss of tension on the elastic brake cable 18 then disengages the upper braking system 10 when then permits the rope 3 to descend until the brake cable 18 has tension re-applied to it which in turn engages the upper braking system 10 based on a degree of tension applied to the brake cable 18.

Alternative embodiments can include an adjustable reel (not shown) attached to the climber which in turn attaches to the brake cable 18 that permits a climber to ascend up to a particular point on the rope and then activate the adjustable reel to selectively apply tension to the brake cable 18 in an initial reel setting so as to begin to retract while climbing and apply tension to the braking cable 18 until a set and adjustable number of cable reel retraction rotations of the reel have occurred during climbing. In one embodiment of the invention a reel can have an adjustable reel lock which permits a certain number of rotations or portion of rotation then engages a releasable locking structure (e.g., a moveable or spring loaded pin that engages with a rotating circular plate with a hole in it that rotates until the pin engages in the plate (not shown)). Tension on the exemplary braking cable 18 is maintained until the climber reaches the adjustable number of reel rotation setting point of the reel on the rope; then the reel will stop retracting and then a climber can release tension on the rope by continued climbing and thereby permit the rope 3 to be released by the upper locking system 10. A loss of tension can release and reset the adjustable reel lock. In other embodiments, upper brake boom 14 can be formed from a flexible material which permits flex or deflection downward with a non-elastic brake cable 18 or with the elastic brake cable 18.

FIG. 4 shows a side view of the FIG. 3 embodiment in one operational configuration. A climber 40 ascends the endless loop of rope 3 that is fed through the apparatus 4A. The upper brake boom 14 extends outward, extending the brake cable 18 that is attached to the climber 40 by an attaching mechanism 35. The upper brake boom 14 is attached to the upper braking mechanism 10 that the brake starts to be released as weight comes off the boom. Brake cable 18 is attached to the climber 40 before ascending the rope 3 then, a weight of the climber 40, transferred by brake cable 18, pulls down on the upper brake boom 14 that then actuates the upper braking mechanism 10, securing the endless loop of rope 3. As the climber 40 ascends the endless loop of rope 3, tension is slowly relieved from brake cable 18 and the upper brake boom 14. This release of tension removes or decreases force applied to the upper braking mechanism 10 on the endless loop of rope 3, allowing the rope to circulate towards the climber 40 due to the climber's weight on the rope providing more length for the climber 40 to ascend.

FIG. 5 shows an alternative illustrative embodiment of a supplementary unit that can be used with embodiments of the invention such as that depicted in FIG. 2, FIG. 3, FIG. 4, etc. The supplementary unit 31 generally can include a supplementary set of pulleys 33 around which the endless loop of rope 3 is run. A lower braking mechanism 11 is incorporated and is able to lock and secure the endless loop of rope 3. Extending outwards from the lower braking mechanism 11 is a lower brake boom 15 that is connected to a brake cable 18. In the FIG. 5 alternative embodiment, in some examples the FIG. 5 supplementary unit can either take the place or interact with rope braking and release structures in, e.g., FIG. 3's Apparatus 4A. Accordingly, braking and release structures can be moved to a lower configuration or can remain at an upper location but be connected with the lower braking mechanism. Embodiments can include an example where the lower braking mechanism 11 can attach to the climber using, e.g. an elastic or stretchable brake cable 18.

FIG. 6 shows a side view of the embodiment of the invention of FIG. 5 in use. A climber 40 ascends the endless loop of rope 3 that is fed through the apparatus 4. A base of the endless loop of rope 3 can be secured through the supplementary unit 31 including a supplementary set of pulleys 33 and a lower braking mechanism 11 from which a lower brake boom 15 extends with a brake cable 18 that is attached to the climber 40 by an attaching mechanism 35. Lower braking mechanism 11 fully secures the endless loop of rope 3 before climber 40 ascension up the rope 3. As the climber 40 ascends, the brake cable 18 pulls up on the lower brake boom 15, which releases tension from the lower braking mechanism 11 on the endless loop of rope 3, which allows the endless loop of rope 3 to circulate towards the climber 40 due to weight and force applied by the climber 40 on the rope 3.

Figure 7:
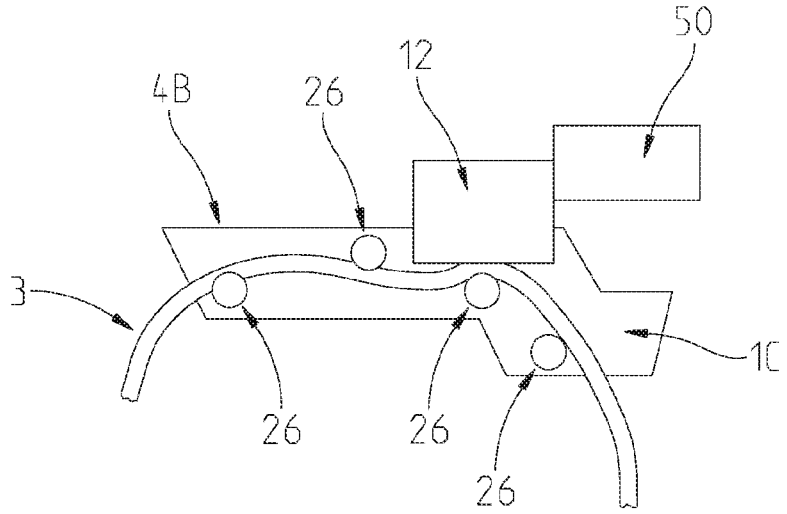
FIG. 7 shows a side view with a partial cross section that shows another illustrative embodiment that incorporates a wireless position sensor system into a braking mechanism.

FIG. 7 shows a side view with a partial cross section of yet another embodiment of the invention. In this embodiment, the FIG. 7 exemplary apparatus 4B generally includes a structural framework 1C with a set of pulleys 26 through which an endless loop of rope 3 runs. A wireless braking mechanism 12 is incorporated in the apparatus 4B, allowing it to secure and lock the endless loop of rope 3 based on the signals provided by or through a primary wireless device 50. The primary wireless device 50 communicates with a separate secondary wireless device 55 that is worn by a user.

Figure 8:
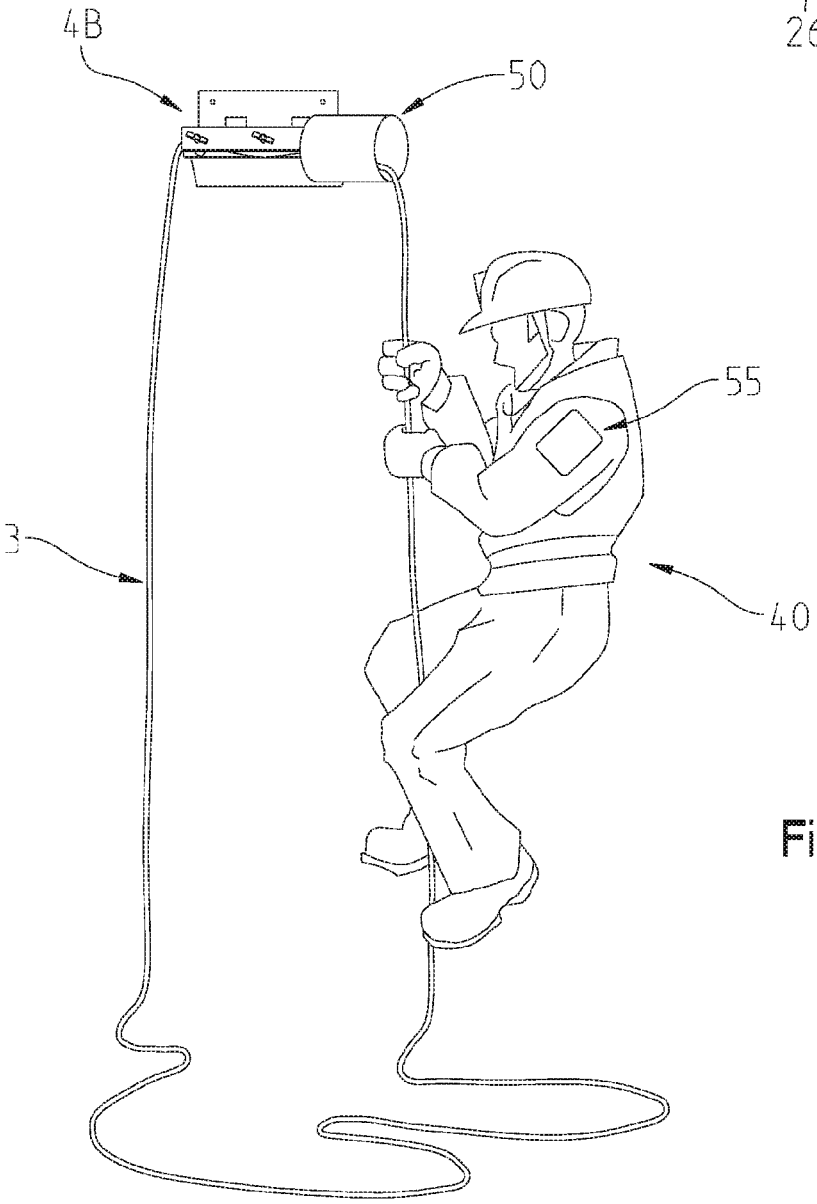
FIG. 8 shows a side view of a climber using one embodiment utilizing a wireless system to activate a brake release.

FIG. 8 shows the embodiment of the invention of FIG. 7 in use. Again, a climber 40 ascends an endless loop of rope 3 that is fed through the apparatus 4B. In this embodiment, a primary wireless unit 50 that wirelessly communicates with a secondary wireless unit 55 replaces a need for physical booms and cables as shown, e.g., in previous FIGS. 6-8. While in active use, a primary wireless unit 50 and a secondary wireless unit 55 continuously detect and communicate their proximity to each other through electronic computing and wireless means such as Bluetooth technology. The wireless braking mechanism (not shown, e.g., see FIG. 7, 12) releases or increases tension on the endless loop of rope 3 according to a predetermined and programmable ratio with respect to the proximity between the primary wireless unit 50 and the secondary wireless unit 55. In the embodiment shown in this figure, this ratio could be set to reduce tension as the proximity increases (i.e. the two units draw closer together). Since the climber 40 wears the secondary wireless unit 55, the proximity increases as the climber 40 ascends. Thus, when the climber reaches a predetermined height, the wireless braking mechanism 12 will reduce tension on the endless loop of rope 3, allowing it to circulate towards the climber 40 by force of gravity.

Figure 9:
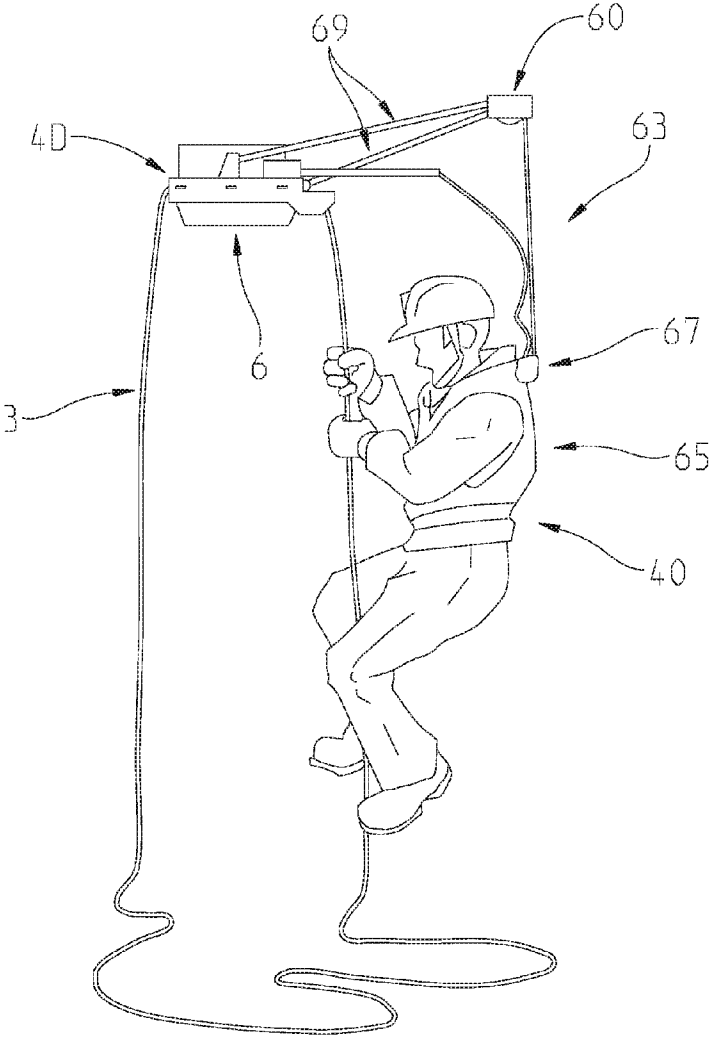
FIG. 9 shows a side view of a climber using another embodiment that includes a safety mechanism and manual brake release.

FIG. 9 shows yet another embodiment of the invention with additional safety features. A climber 40 ascends an endless loop of rope 3 that is fed through the apparatus 4D that is secured by a mount 6 to a vertical surface. In this embodiment, a climber 40 wears a safety harness 65 that is attached to a safety line 63 by an attaching mechanism 67. The safety line 63 terminates by being spooled around a reel within a safety line reel mechanism 60 that is supported by safety reel support rods 69. This embodiment can be configured to have functions like the embodiment presented in FIG. 4. Safety features of the safety line 63 and safety line reel mechanism 60 take action in the event the climber 40 falls. In the event of a sudden descent, the inertial locking system within the safety line reel mechanism 60 locks, catching the climber 40, though under gentle motion the safety line 63 can freely retract and extend.

Figure 10:
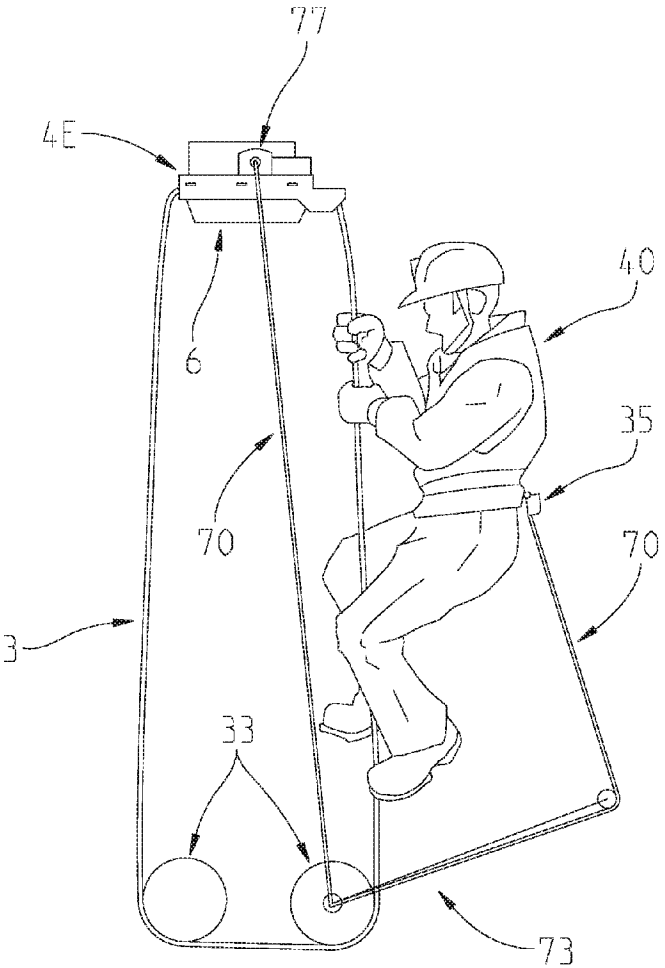
FIG. 10 shows a side view of a climber using another embodiment that includes a mechanical automatic brake release system that is directed through a supplemental pulley system.

FIG. 10 shows another illustrative embodiment of the invention. In this embodiment, a climber 40 climbs an endless loop of rope 3 that is fed through exemplary apparatus 4E that can be secured on a mount 6. The endless loop of rope 3 also can pass around supplemental pulley system 33. An attaching mechanism 35 attaches brake release line 70 to the climber 40. The brake release line 70 is directed by a brake line boom 73 around the supplementary pulley system 33 and ultimately into a camshaft brake release system 77 in the apparatus 4E. With the arrangement depicted, as climber 40 ascends the rope, the brake release line 70 raises the brake line boom that, in turn, continuing through the brake line 77, actuates on camshaft brake release system 77 releasing the brake. This allows the endless loop of rope 3 to circulate, allowing the climber 40 to descend.

Figure 11:
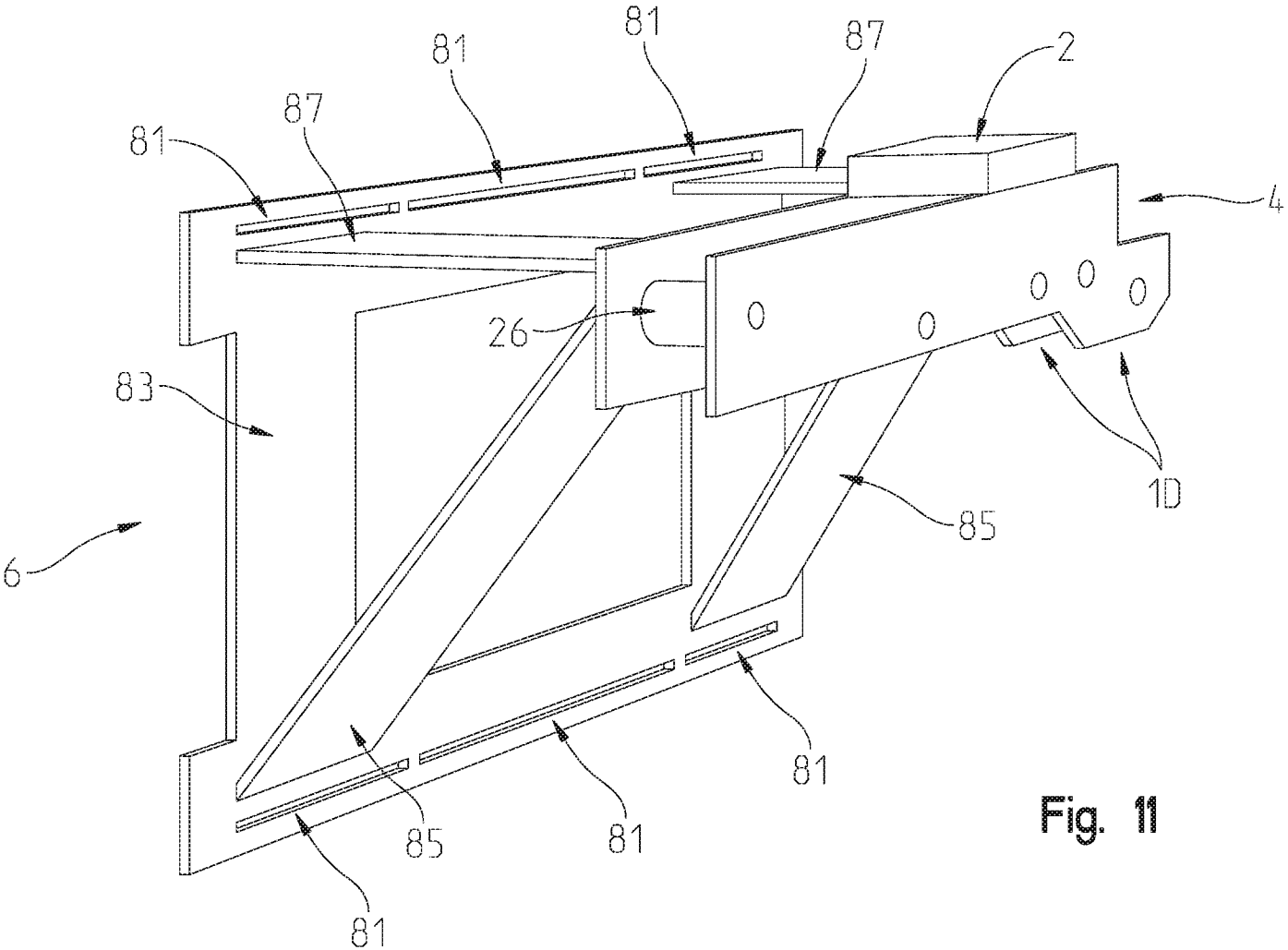
FIG. 11 shows a perspective view of an illustrative embodiment of a wall mount for use with an exemplary rope-climbing apparatus.

FIG. 11 shows an illustrative embodiment of a mount 6 upon which to secure an embodiment of the invention. The apparatus 4, shown with visible components structural framework 1D, control system 2, and component of pulley system 26, is attached to mount 6. The mount 6 is shown generally comprising of a back plate 83 with grooves 81 to allow for various securing methods, such as nails or screws, to a surface. From the back plate 83 extend at right angles perpendicular support beams 87. Also extending from back plate 83 are oblique support beams 85 at an acute angle relative to the back plate 83 and perpendicular support beams 87. Though this embodiment makes use of two sets of two different support beams at right and acute angles, other support beam numbers and angles are possible and included within the scope of the invention.

Figure 12:
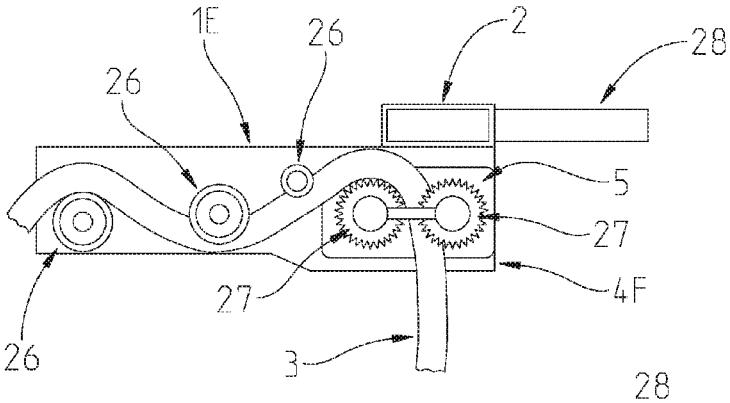
FIG. 12 shows a side view with a partial cross section of another embodiment that includes an electric motor and control system.

Referring to FIG. 12, another embodiment of the invention is presented in a partial cross-sectional side view. The FIG. 12 exemplary rope speed and braking apparatus 4F is depicted as having a structural framework 1E that houses a pulley system 26 through which an endless loop of rope 3 runs. The endless loop of rope 3 also passes through a set of locking pulleys 27 which are able to provide sufficient frictional force to lock the endless loop of rope 3. This locking set of pulleys 27 are connected to a speed induction motor 5. A control system 2, in this embodiment connected to a sensor boom 28, determines the speed of the speed induction motor 5.

Figure 13:
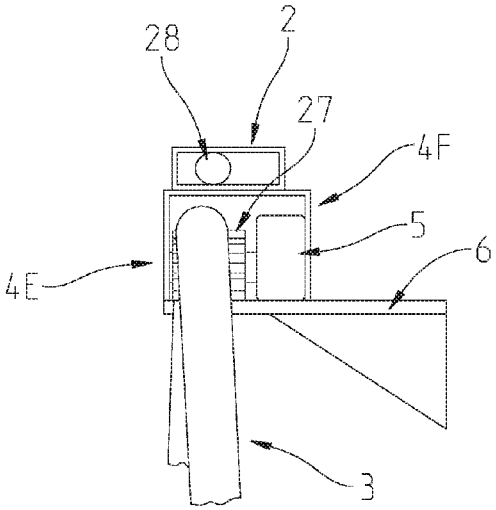
FIG. 13 shows a front view of an embodiment that includes an electric motor and control system.

FIG. 13 shows a front view of the same embodiment as FIG. 12. The apparatus 4F has a structural framework 1E, secured to a mount 6. The endless loop of rope 3 passes through the locking set of pulleys 27, which are in-turn connected to a speed induction motor 5. The speed induction motor 5 is controlled by a control system 2, which in this embodiment is connected to a sensor boom 28.

Figure 14:
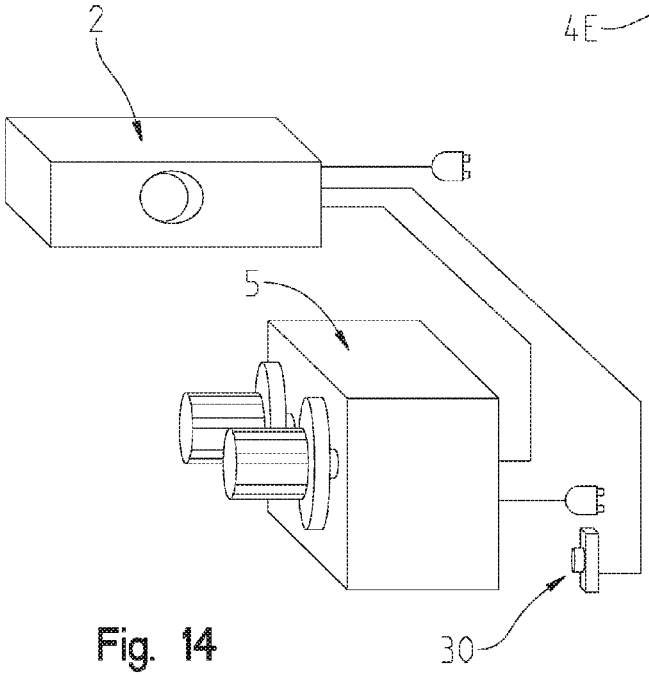
FIG. 14 shows a perspective view of an illustrative simplified control system and motor.

FIG. 14 shows a relationship between control system 2 and speed induction motor 5 in a perspective view. In this embodiment, an on/off switch 30 can be connected to the control system 2.

Figure 15:
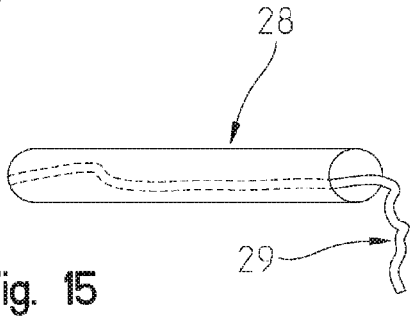
FIG. 15 depicts a perspective view of an illustrative simplified elastic boom and sensor.

FIG. 15 shows a perspective view of an illustrative embodiment of an elastic sensor boom 28 that contains and directs a loose sensor 29 that can be used in various embodiments of this disclosure.

Embodiments can include loadbearing structures or coupling approaches to couple brake cable (e.g. FIG. 4, 18) to a user such as, e.g., a karabiner (e.g., a metal structure such as a loop with an adjustable locking gate configured to permit a structure to be inserted into the loop), knot, a harness attachment, a hook, shackle, hardware, connectors, an attaching link, or other structure including auto locking, manual locking, and non-locking structures. Such load bearing or coupling approaches can include structures that meet Occupational Safety and Health Administration standard 1910.66 App C Personal Fall Arrest System which specifies "drop forged, pressed or formed steel, or made of equivalent materials" and a minimum breaking strength of 5,000 lbf, American National Standards Institute/American Society of Safety Engineers standard ANSI Z359.1-2007 Safety Requirement for Personal Fall Arrest Systems, Subsystems and Components, section 3.2.1.4 (for snap hooks and karabiners) (This standard requires connectors/karabiners support a minimum breaking strength (MBS) of 5,000 lbf (22 kN) and feature an auto-locking gate mechanism which supports a minimum breaking strength (MBS) of 3,600 lbf (16 kN)). Another embodiment can include the load bearing or coupling approaches having a design compliant with minimum breaking strength requirements and calculations for rescue karabiners set out in National Fire Protection Association standard 1983 Fire Service Life Safety Rope and Equipment. The NFPA standard defines two classes of rescue karabiners. Light use rescue karabiners are required to have minimum breaking strengths of 27 kN gate closed, 7 kN gate open and 7 kN minor axis. General use rescue karabiners are required to have minimum breaking strengths of 40 kN gate closed, 11 kN gate open and 11 kN minor axis. Testing procedures for rescue karabiners are set out in ASTM International standard F 1956 Standard Specification of Rescue Karabiners.

Alternative embodiments can include an adjustable friction or braking mechanism that can selectively adjust braking of friction forces applied to the climbing cable or rope (e.g. FIG. 4, 3) used with an embodiment of the invention. Such adjustable features can be used to adjust a braking mechanism to account for weight of a climber as well as weight of a climber's equipment carried during climbing that necessitates increasing or decreasing braking force applied to the climbing rope or cable (e.g. 3) used with an embodiment of the invention. For example, an adjustment knob positioned so a user can access it coupled to a compression spring can be used to as an adjustable tensioner for applying selective for to the rope or cable (e.g. 3). Another embodiment might include an adjustable structure that changes a distance between a friction brake or structure and the rope or cable (e.g. 3) routed through it. Another alternative embodiment can include a cam structure that can be turned or adjusted to increase or decrease distance between a friction or braking structure and the rope or cable (e.g. 3). Another embodiment can include a variant which permits slippage of the climbing rope or cable (e.g. 3) after a specified weight is applied to the rope or cable than then results in an adjustably fixed rate of slippage used in addition or separate from embodiments which include, e.g. a brake boom (14 or 15).

Figure 16:
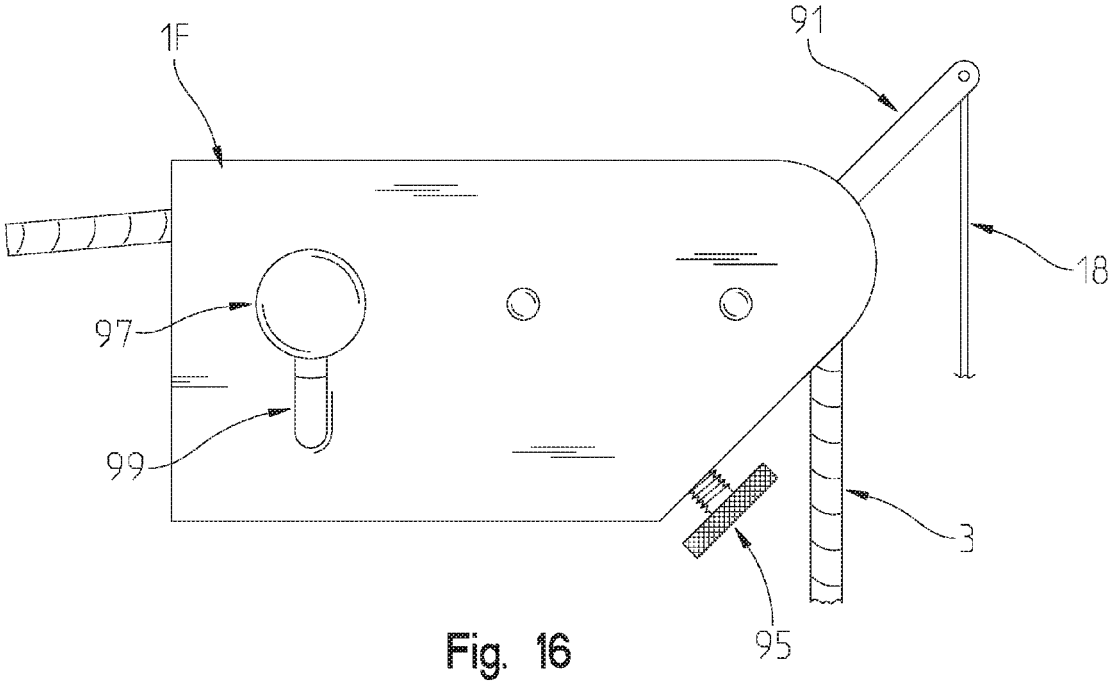
FIG. 16 shows an external side view of an illustrative embodiment of an upper mechanical braking system.

FIG. 16 shows an external side view of one embodiment of an upper braking system that comprises additional features. Visible in the figure are the structural framework 1F, the endless loop of rope 3, as well as an upper brake lever 91 and brake cable 18. Also visible are a rope tension pulley adjustment knob 97 that extends out from the rope tension pulley adjustment slot 99 perpendicularly from the plane of the structural framework 1F. Finally, a brake tension adjustment knob 95 extends out in line with the plane of the structural framework 1F.

Figure 17:
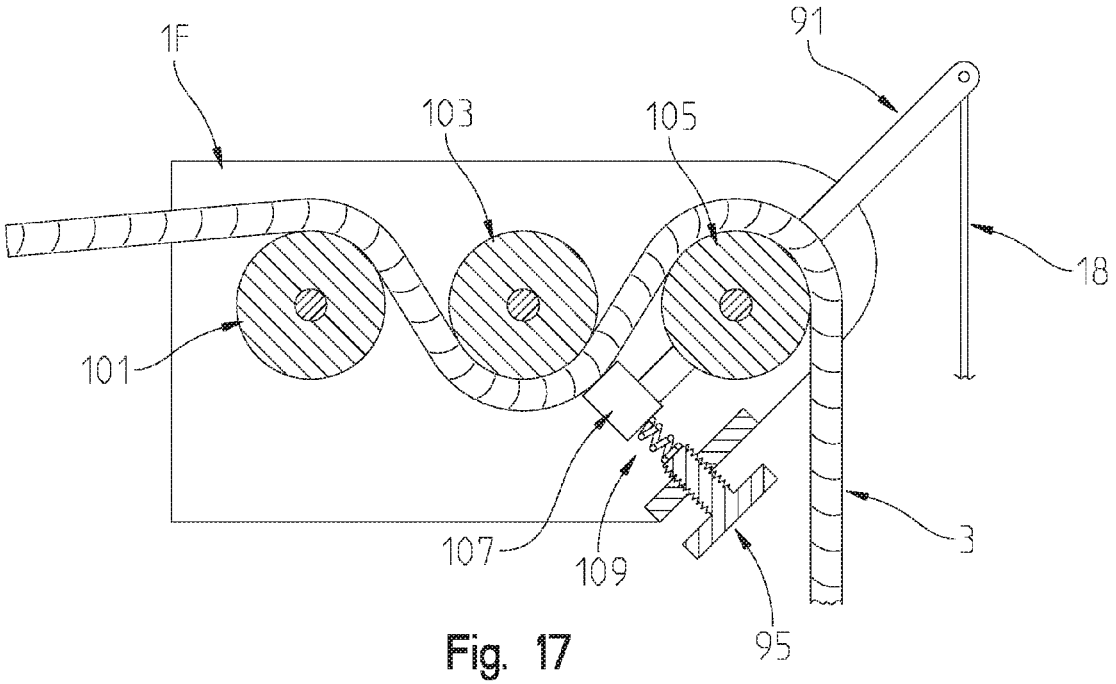
FIG. 17 shows a cross-sectional side view of the FIG. 16 embodiment.

FIG. 17, in a cross-sectional view of the same embodiment, shows the inner workings of this embodiment. Within this exemplary structural framework 1F, there are at least three pulleys: a rope tension pulley 101, a brake pulley 103, and an alignment pulley 105. The endless loop of rope 3 passes around all three of those pulleys. The exemplary brake cable 18 connects to one end of the upper brake lever 91 that terminates on its opposite end in a brake 107 that comprises material capable of applying high friction, e.g. rubber. Coupled to said brake 107 is a brake tension spring 109 that, on its opposite end, couples to a brake tension adjustment knob 95. When weight or force is appropriately applied on the brake cable 18, it pulls on said upper brake lever 91 that then presses said brake 107 into said endless loop of rope 3. The high friction produced on the endless loop of rope 3 by the brake 107 stops and/or hinders the circulation of said endless loop of rope 3. An amount of force said brake 107 applies on the rope can be adjusted via said brake tension adjustment knob 95. Turning the brake tension adjustment knob 95 extends or retracts said brake tension spring 109 by means of a threaded interaction of the knob with the structural framework 1F. Tightening said brake tension adjustment knob 95 facilitates braking by adjusting a distance between said brake 107 and said endless loop of rope 3. Inversely, loosening the brake tension adjustment knob increases a distance between the brake 107 and the endless loop of rope 3, thereby requiring more motion of upper brake lever 91, and therefore more force on the brake cable 18, to achieve the same amount of frictional force and braking power. A speed of circulation of the endless loop of rope can also be adjusted by means of the rope tension pulley 101 that is coupled to a rope tension adjustment knob (not shown, but see FIG. 15, 97) that comprises a threaded interface that is fitted along the rope tension pulley adjustment slot (not shown, but see FIG. 15, 99). Twisting the rope tension adjustment knob (not shown, but see FIG. 15, 97) raises or lowers the rope tension pulley 101 that then increases or reduces tension on the endless loop of rope 3. Increasing tension slows the endless loop of rope's 3 rate of circulation; inversely, decreasing tension facilitates its circulation.

Figure 18:
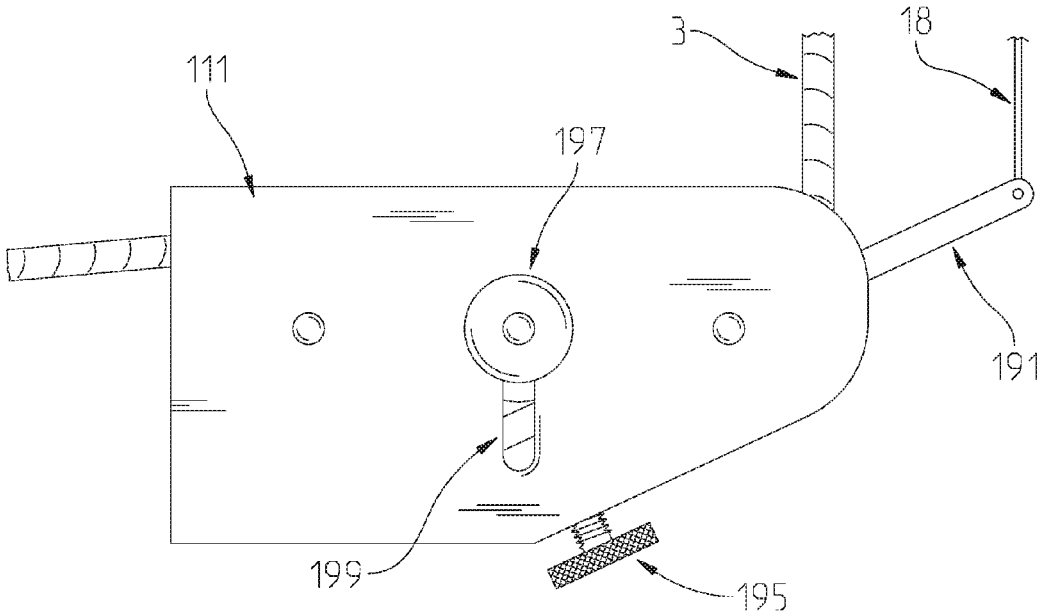
FIG. 18 shows an external side view of an illustrative embodiment of a lower mechanical braking system.
Figure 19:
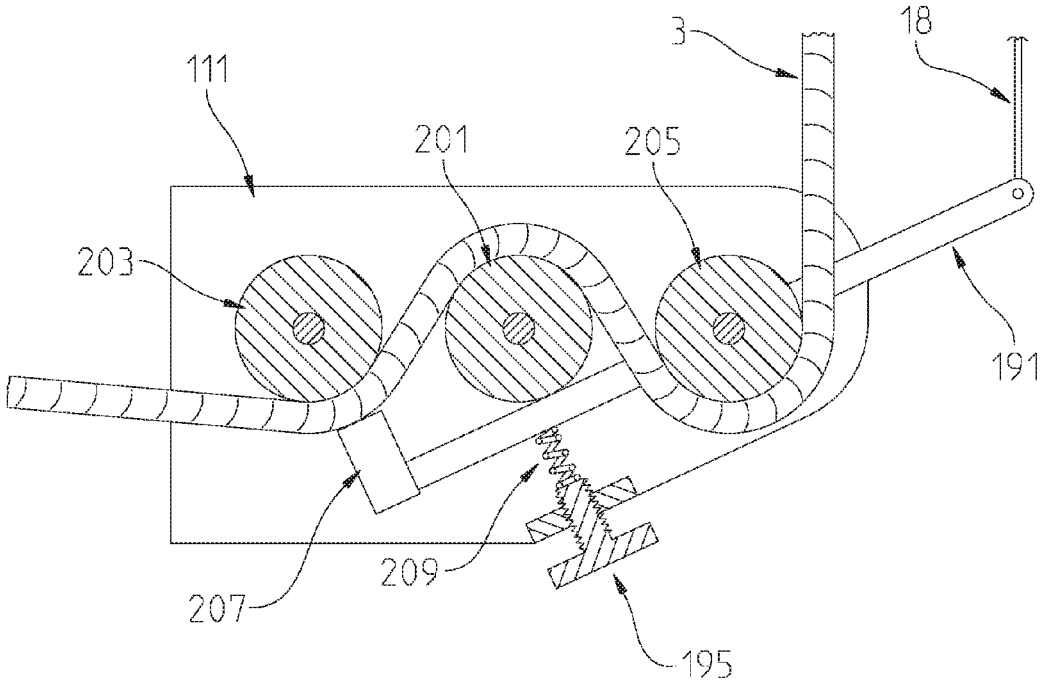
FIG. 19 shows a cross-sectional side view of the FIG. 18 embodiment.

FIG. 18 shows an external side view of a similar embodiment for a braking system but one that is installed in a supplemental lower pulley system (e.g. FIG. 6). A supplemental structural framework 111, endless loop of rope 3, brake cable 18, and a lower brake lever 191 are visible in the figure. Extending out from the plane of the supplemental structural framework 111 from a lower rope tension pulley adjustment slot 199 is a lower rope tension pulley adjustment knob 197. A lower brake tension adjustment knob 195 also extends outwards but in the plane of the supplemental structural framework 111. FIG. 19 shows a cross-section of the same embodiment as FIG. 18. Coupled to the supplemental structural framework 111 are at least three pulleys: a rope tension pulley 201, a brake pulley 203, and an alignment pulley 205. An endless loop of rope 3 is directed by at least these three pulleys. The brake cable 18 connects to one terminal end of said lower brake lever 191 that terminates its opposite end in a brake 207 comprising a material with a high coefficient of friction, e.g. rubber. A threaded lower brake tension adjustment knob 195 is coupled to a brake tension spring 209 that is coupled to the lower brake lever 191. Appropriately applying force on the brake cable 18 pulls on said lower brake lever 191 that, in turn, pulls said brake 209 away from the endless loop of rope 3, allowing the endless loop of rope 3 to circulate. Turning the lower brake tension adjustment knob 195 facilitates or inhibits braking in a manner analogous to its counterparts in the alternative embodiment such as, e.g., discussed above. Tightening the brake tension adjustment knob 195 facilitates braking, whereas loosening it weakens the brake's 207 braking power. Similarly, circulation of the rope can be adjusted by means of raising or lowering the rope tension pulley 201 by means of twisting the threaded rope tension pulley adjustment knob (not shown, see FIG. 18, 197) that is fitted inside the rope tension pulley adjustment slot (not shown, see FIG. 18, 199) as discussed above.

Figure 20:
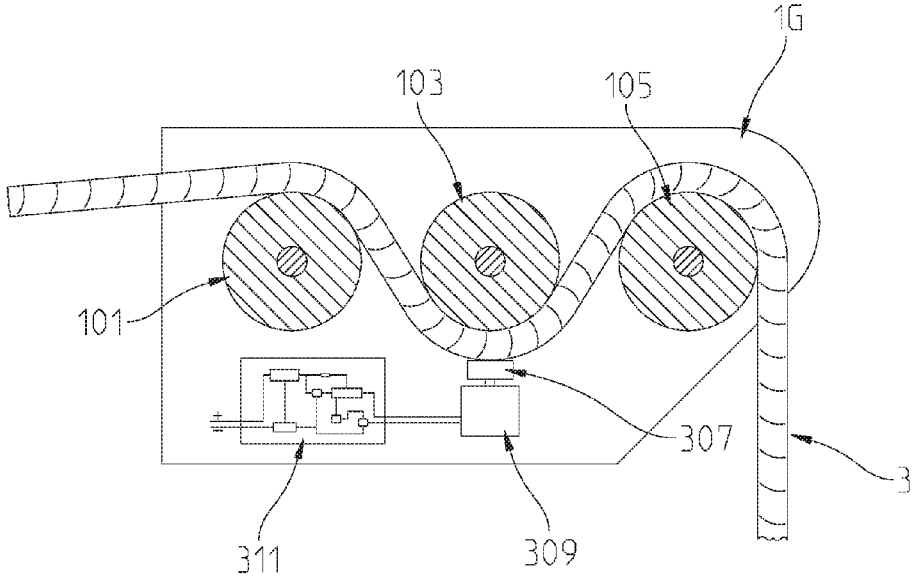
FIG. 20 shows a cross-sectional side view of an illustrative embodiment of an upper braking system fitted with an electronic braking system.

FIG. 20 shows a cross-sectional side view of another alternate embodiment of a braking system involving an electronic braking system. A structural framework 1G houses at least three pulleys: a rope tension pulley 101, a brake pulley 103, and an alignment pulley 105. An endless loop of rope 3 is directed around at least these three pulleys. A brake 307, comprising material with a high coefficient of friction, e.g. rubber, is coupled to an electronic actuator 309 that is in electronic communication with a circuit 311 comprising a CPU that is in electronic communication with an electronic transmitter/receiver system (not shown, see FIG. 8). Said circuit 311 may further comprise a radio antenna and be in radio communication with said electronic transmitter/receiver system (not shown, but see FIG. 8). Upon receiving a predetermined signal, said circuit 311 directs said electronic actuator 309 to press said brake 307 into said endless loop of rope 3, thereby applying friction onto said endless loop of rope 3 and breaking its circulation. This embodiment may further comprise a rope tension pulley adjustment knob (not shown, see FIG. 16, 97) and a rope tension pulley adjustment slot (not shown, see FIG. 16, 99).

Figure 21B:
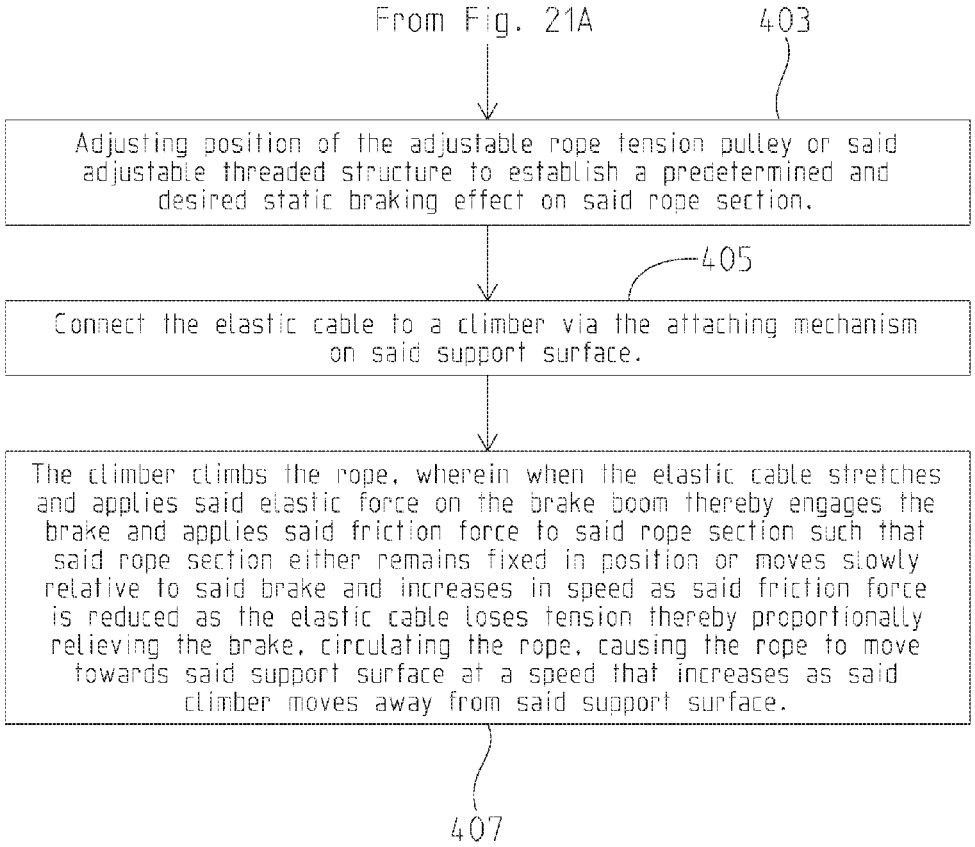

FIGS. 21A and 21B show an exemplary method in accordance with one embodiment of the invention. At Step 401—Provide, access, or initiate use or operation of a rope climbing system (e.g., see FIG. 17,) that includes a first apparatus comprising a housing having a first and second axis where said first axis is perpendicular to said second axis, an adjustable threaded structure coupled to said housing, a set of pulleys including an adjustable rope tension pulley assembly disposed in said housing, a loop of textured rope disposed through and on the set of pulleys, a brake disposed in said housing attached to a brake boom that extends away from the brake and said housing within an arc defined by an angle of up to thirty degrees above and below said first axis, a spring connected to both the brake boom and said adjustable threaded structure, and an elastic cable connected to a first end of the brake boom on an opposing end of a second end of the brake boom coupled to the brake, wherein the elastic cable further comprises an attaching mechanism adapted to attach to a rope climber who ascends a portion of the rope, wherein said rope extends away from said housing along said first axis and from a first and second location of said housing, wherein said elastic cable has a first length configured to enable said elastic cable to stretch between ten and thirty percent of its length from a fully down deflected position of said brake boom down to a point above a support surface underneath said rope climbing system that said rope climber will assume as an initial climbing position at which the elastic rope is coupled to said rope climber's body, wherein said elastic rope is configured or formed to decrease an elastic force on said brake boom until said rope climber ascends to a point on said loop that all said elastic force is relaxed on said brake boom, wherein said elastic force is proportional to an amount of torque the brake boom applies to said brake, wherein said friction force applied by said brake is altered or adjusted by altering position of at least one said adjustable rope tension pulley assembly or the adjustable threaded structure that adjusts position of said spring, wherein said adjustable threaded structure is adapted to selectively move said brake towards or away from a section of said rope between one of said pulleys and said brake to apply or release a static friction force against said section of said rope, wherein said housing is further formed with first and second elongated apertures which is parallel to said axis and is formed on opposing sides of said adjustable rope tension pulley assembly and is configured to enable said adjustable rope tension pulley assembly to move within said aperture to alter said friction forces on said section of said rope, said adjustable rope tension pulley assembly is further formed with a threaded knob that threadedly engages with said adjustable rope tension pulley assembly to apply a movement restriction force to said adjustable rope tension pulley assembly to fix said adjustable rope tension pulley assembly relative to said housing. At Step 403—Adjusting position of the adjustable rope tension pulley or said adjustable threaded structure to establish a predetermined and desired static braking effect on said rope section. At Step 405—Connect the elastic cable to a climber via the attaching mechanism on said support structure. At Step 407—The climber climbs the rope, wherein when the elastic cable stretches and applies said elastic force on the brake boom thereby engages the brake and applies said friction force to said rope section such that said rope section either remains fixed in position or moves slowly relative to said brake and increases in speed as said friction force is reduced as the elastic cable loses tension thereby proportionally relieving the brake, circulating the rope, causing the rope to move towards said support platform at a speed that increases as said climber moves away from said support platform.

Figure 22B:
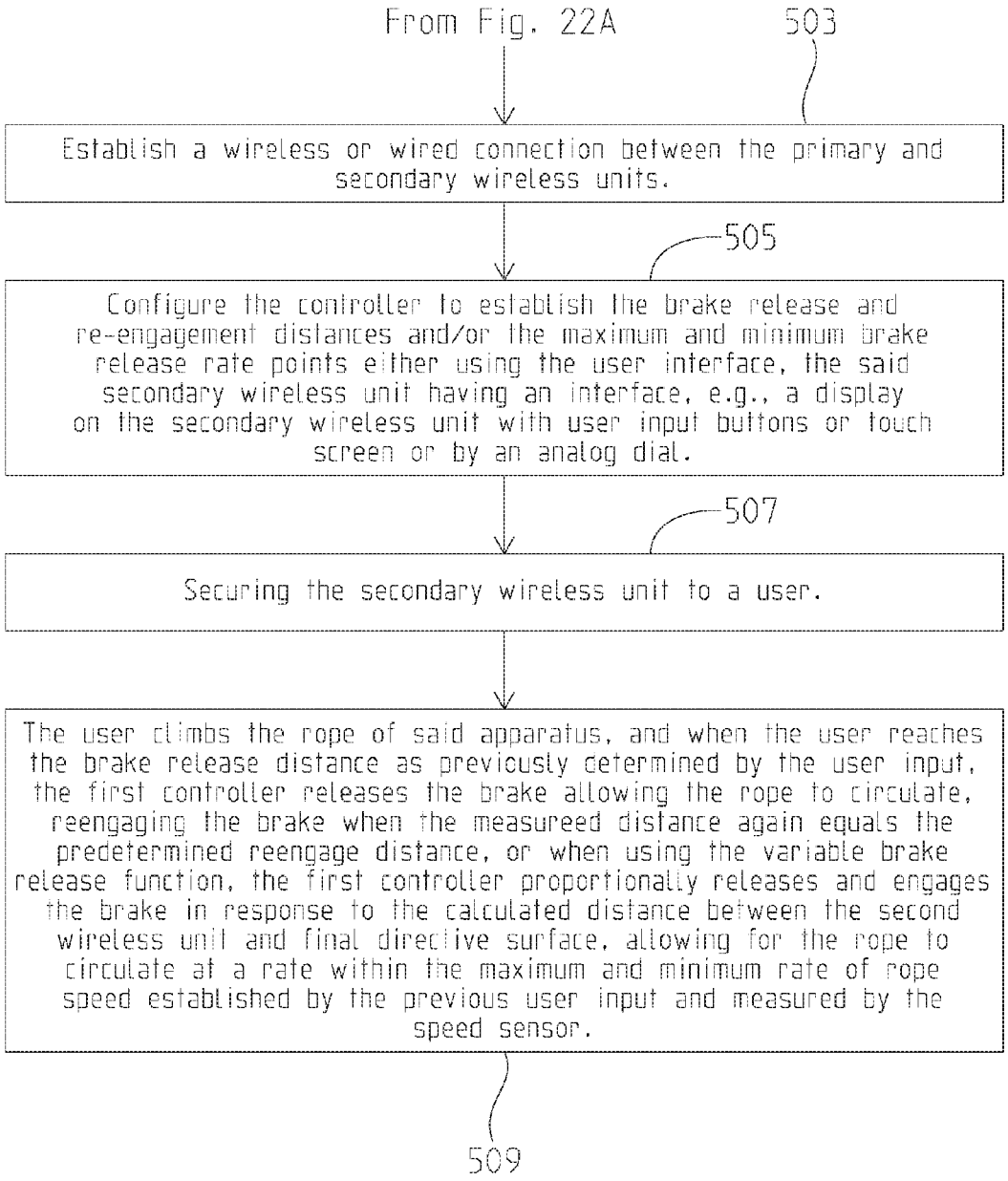
FIG. 22B shows a continuation of the exemplary method of FIG. 22A.

Referring to FIG. 22A, at Step 501—Initiate operation of a rope climber system, e.g., such as that which is described in FIG. 20, that includes a first apparatus comprising a first controller, a first user interface in wired communication with the first controller, a rope braking system and a brake actuator, a primary wireless unit positioned in proximity with the controller, an endless loop of rope, and a plurality of contact surfaces to direct the rope including a final surface that is the last directive surface that a portion of the endless loop of rope interacts with before that portion of the endless loop of rope exits the first apparatus; the system further including a second apparatus comprising a secondary wireless unit, a second user interface, and a second controller in a user case configured to attach to the user, wherein the primary wireless unit is configured to communicate with the secondary wireless unit positioned on a user, wherein the first apparatus is further configured to determine an actual distance between the primary and secondary wireless units based on wireless transmission distance measurements, the controller further includes a section configured to receive a brake release distance setting, and a re-engagement distance via the user interface, wherein the brake release distance setting defines a rope release distance between the primary and secondary units when the controller operates the braking actuator to release the rope controlled by the apparatus to permit the rope to circulate until the re-engagement distance is measured between the primary and secondary wireless units, wherein the controller is further configured to apply a variable friction to the rope based on distance between the primary wireless unit and the secondary wireless unit having a pre-determined and user-defined maximum and minimum rope release rate points at set but variable distances that can be established via the first or second user interface, wherein the controller is further configured to determine a distance between the secondary wireless unit and the final directive surface via a computation performed by the first controller, the computation being, e.g., the Pythagorean theorem using the measured distance as the hypotenuse and a predetermined distance between the first wireless unit and the final directive surface as a leg of a right triangle, and wherein the first apparatus further comprises a rope speed sensor comprising an motor-generator including an electronic database of a table of voltage to rope speed ratios, a processor, and a pulley about which runs the rope, wherein the circulation of the rope spins the pulley of the motor-generator to produce a voltage, the processor then references the induced voltage to the database to determine the speed of the rope, and wherein the first apparatus is secured to a wall, ceiling, or other supporting structure. At Step 503—Establish a wireless or wired connection between the primary and secondary wireless units. Step 505—Configure the controller to establish the brake release and re-engagement distances and/or the maximum and minimum brake release rate points either using the user interface, the said secondary wireless unit having an interface, e.g., a display on the secondary wireless unit with user input buttons or touch screen or by an analog dial. At Step 507—Securing the secondary wireless unit to a user. At Step 509—The user climbs the rope of said apparatus, and when the user reaches the brake release distance as previously determined by the user input, the first controller releases the brake allowing the rope to circulate, reengaging the brake when the measured distance again equals the predetermined reengage distance, or when using the variable brake release function, the first controller proportionally releases and engages the brake in response to the calculated distance between the second wireless unit and final directive surface, allowing for the rope to circulate at a rate within the maximum and minimum rate of rope speed established by the previous user input and measured by the speed sensor.

Another embodiment can include use of a flexible boom which displaces based on weight of the climber that permits the climber to attach the boom tether or coupling structure to the climber in preparation for climbing up the apparatus' rope. Another embodiment can include an adjustable tether or coupling structure which permits adjustment of the tether or coupling structure based on, e.g. height of a climber, so as to adjust operation of the braking system.

Alternative embodiments can include additional safety features such as structures which address falls by a climber off the rope which address falls and either support the climber and/or permit a controlled failure mode such as for the boom. For example, the boom can be designed to support the climber's weight and flex up to a maximum length so as to prevent a climber from falling to a ground surface. Another embodiment can include a design to support a climber's weight up to a specific force then have a structure such as a two piece boom which are coupled together by a pivot in overlapping sections which are also coupled in another portion of the overlapping sections by a shear pin which would permit the boom to pivot downwards after a predetermined force is applied that snaps or shears the shear pin and permits an outer boom section coupled to the climber to pivot downwards. The shear pin and pivot coupling of the two overlapping boom sections can be part of a system to slow a falling climber to reduce impact from a fall.

Although the invention has been described in detail with reference to certain preferred embodiments, variations and modifications exist within the spirit and scope of the invention as described and defined in the following claims.

The invention claimed is:

1. An apparatus for rope climbing comprising:

a mount comprising a frame and a plurality of attachments;

a plurality of supports;

a rope supported by the plurality of supports and configured for attachment to a user;

a braking mechanism coupled with the mount;

a plurality of pulleys, each fitted into a slot in the mount to allow for the raising and lowering of the pulley to increase or reduce tension on the rope;

a control unit comprising a first wireless transmitter and receiver, wherein the control unit is attached to the braking mechanism and is configured to control the braking mechanism; and a second wireless transmitter and receiver unit configured to be coupled to the user, wherein the first and second wireless transmitter and receiver units communicate with each other to detect the distance between the first and second wireless transmitter and receiver units, and wherein the control unit is configured to control the braking mechanism in response to the detected distance.

2. The apparatus as in claim 1, wherein the rope has a diameter of 1.5 inches.

3. The apparatus as in claim 1, wherein the rope has a first length of 20 to 30 feet.

4. The apparatus as in claim 1, wherein the rope is formed in an endless loop.

5. The apparatus as in claim 1, wherein the rope comprises natural fibers, hemp, manila hemp, synthetic polymer fibers, polyester polymers, nylon, or polyethylene polymers.

6. The apparatus as in claim 1, wherein the rope is formed with a rough texture to facilitate frictional gripping by the user.

7. The apparatus as in claim 1, wherein the rope is of a three-strand or four-strand twisted construction in either an "S" or "Z" twist.

8. The apparatus as in claim 1, wherein the rope is of a single braid, double braid, or kermantle construction.

9. The apparatus as in claim 1, wherein the rope has a Young's modulus between 5 and 150 GPa.

10. The apparatus as in claim 1, wherein the braking mechanism further comprises:

a spring; and a threaded screw configured to rotate to compress or decompress the spring to increase or decrease the braking tension on the rope.

11. The apparatus as in claim 1, wherein the braking mechanism comprises a material formed to produce a coefficient of friction of at least 0.75.

12. The apparatus as in claim 1, wherein the first and second wireless transmitter and receiver units each comprise a radio antenna configured for communication between the two units.

13. A method of manufacture comprising:

a mount comprising a frame and a plurality of attachments;

a plurality of supports;

a rope supported by the plurality of supports and configured for attachment to a user;

a braking mechanism coupled with the mount;

a plurality of pulleys, each fitted into a slot in the mount to allow for the raising and lowering of the pulley to increase or reduce tension on the rope;

a control unit comprising a first wireless transmitter and receiver unit, wherein the control unit is attached to the braking mechanism and is configured to control the braking mechanism; and a second wireless transmitter and receiver unit configured to be coupled to the user, wherein the first and second wireless transmitter and receiver units communicate with each other to detect the distance between the first and second wireless transmitter and receiver units, and wherein the control unit is configured to control the braking mechanism in response to the detected distance.

* * * * *